United States Patent [19]

Shelton

[11] 4,333,637

[45] Jun. 8, 1982

[54] CHIROPRACTIC TABLE WITH PAPER RETAINER

[76] Inventor: Robert B. Shelton, 726 W. 600 South, Brigham City, Utah 84302

[21] Appl. No.: 151,117

[22] Filed: May 19, 1980

[51] Int. Cl.[3] ..... A61G 13/00

[52] U.S. Cl. ..... 269/322; 5/488; 297/221; 225/82; 206/389

[58] Field of Search ..... 269/322–328; 206/389; 5/434, 487, 488, 489; 128/69–70, 76 R; 225/82, 84–87; 297/221, 222

[56] References Cited

U.S. PATENT DOCUMENTS

| | | | |
|---|---|---|---|
| 393,632 | 11/1888 | Ehrlich | 225/82 X |
| 1,062,931 | 5/1913 | Salmon | 297/222 |
| 4,245,626 | 1/1981 | Paolino | 128/70 |

*Primary Examiner*—Robert C. Watson
*Attorney, Agent, or Firm*—A. Ray Osburn

[57] ABSTRACT

A chiropractic table comprising a cushioned platform upon which a patient is positioned pronely for treatment, a strip of sanitary paper in rolled supply and covering a portion of the face cushions transversely, and a manually releasable paper retainer clamping the full width of the free end of the rolled strip. The free end of the paper strip is clamped between an elongate, tubular clamping member normally urged by suitable springs towards bearing upon a matching elongate surface of a base member, which is secured to a side of the base of the face cushions opposite the paper supply roll. A handle is provided by which the springs are manually overridden to release the paper, to allow the used portion of the paper to be drawn through the retainer off the cushions to be replaced by a fresh portion, the handle then being released so that the paper is again clamped. The table may be of the tilting or stationary type.

15 Claims, 6 Drawing Figures

CHIROPRACTIC TABLE WITH PAPER RETAINER

BACKGROUND OF THE INVENTION

1. Field

The field of the invention is chiropractic tables.

2. State of the Art

Medical examination and treatment tables commonly utilize disposable sanitary paper to cover the patient contacted surfaces. Chiropractic tables in particular commonly utilize a relatively narrow strip of such paper transversely across the table under the face of the patient, who lies face down and must breathe against the table. The paper is commonly provided in a roll on one side of the table, with the strip extending across the face cushions with its free end held on the opposite side of the table. One device for holding the paper comprises an elongate flat member which is manually pivoted scissor-like into close matching relationship with a flat base member secured to a side of the table to frictionally grip the paper between the matching flat sides of the two members. Unless built to very close tolerances, such a device tends to either cut the paper strip, or at best to retain it only loosely and non-uniformly over its width, so that it tends to work partially or completely free to wrinkle and fold excessively. Such retainers are dangerous to the patient when inadvertently left open, with the elongate pivoted member then extending inches above the table. Another paper retaining device comprises a band of elastic material secured in tensioned condition through its ends to the side of the table. The device tends to relax with time and use to lose its capability to elastically grip the paper. Since the paper is quite thin, and is quite smoothly textured for the comfort of the patient, considerable tension is needed. The band is generally roughened, but still inadequately holds the paper its full width, so that it partially or completely pulls out to hang freely with excessive folding and wrinkling. The elastic band is also clumsy to grip to pull it away from the table to draw the paper through.

BRIEF SUMMARY OF THE INVENTION

The present invention eliminates or significantly alleviates the aforesaid disadvantages of present chiropractic and medical tables by providing such a table having a manually releasable spring-loaded retainer clamping the free end of the strip of disposable sanitary paper used to cover the face cushions of the table. The paper retainer comprises an elongate base member secured to a convenient portion of the side of the table opposite the supply roll, and an elongate clamping member urged by spring means toward matching bearing upon the base member so as to grip substantially the full width the free end of the paper strip therebetween. The spring means are manually overridden to release the paper strip so that the used portion may be drawn from the cushions through the retainer drawing a fresh portion onto the cushions. According to one aspect of the invention, the spring-loaded clamping member may be affixed directly to the table, the paper in that event being clamped between the clamping member and the side of the table. According to another aspect of the invention, the clamping force may be magnetic.

It is a principal object of the invention to provide a paper retainer for chiropractic and medical tables which firmly clamps substantially the full width of a sanitary paper strip, and which is easily manipulated to change the paper.

BRIEF DESCRIPTION OF THE DRAWINGS

In the accompanying drawings, which represent the best mode presently contemplated for carrying out the invention.

DETAILED DESCRIPTION OF ILLUSTRATED EMBODIMENTS

Figure 1:
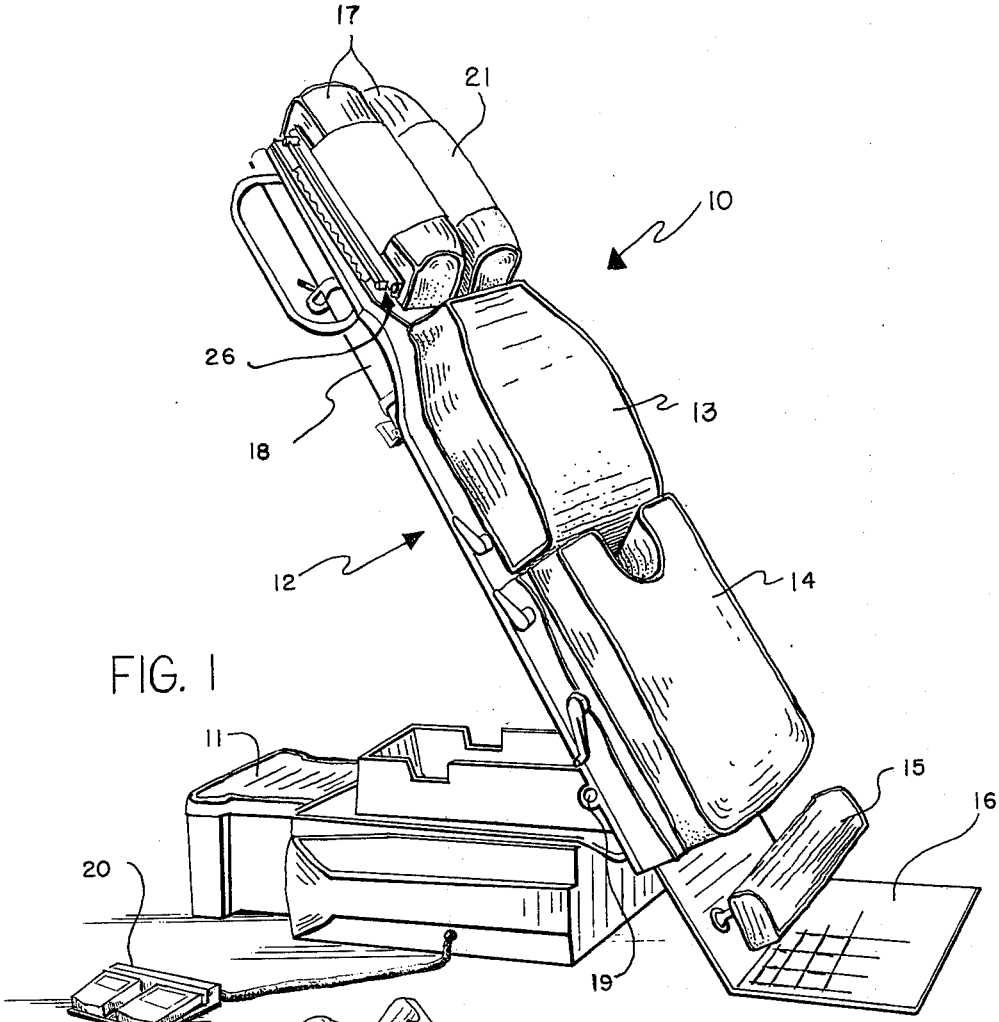
FIG. 1 is a perspective view of a chiropractic table.

A chiropractic table, generally 10, is seen in FIG. 1, comprising a base structure 11 and a patient table, generally 12, having body cushions 13 and 14, shin cushion 15, foot platform 16, and a pair of face cushions 17. The face cushions 17 are each secured upon flat cushion baseboard 25 of wood, concealed in FIG. 1 by individual cushion covers of leather or the like, to a tubular table frame 18. Patient table 12 is secured to base 11 through a pair of axially aligned transverse pivots 19, so that the physician may control the tilt angle of table 12 from near vertical to horizontal. Tilting may be done manually or by an electric motor, not shown, in base 11 controlled by foot pedals 20.

Figure 2:
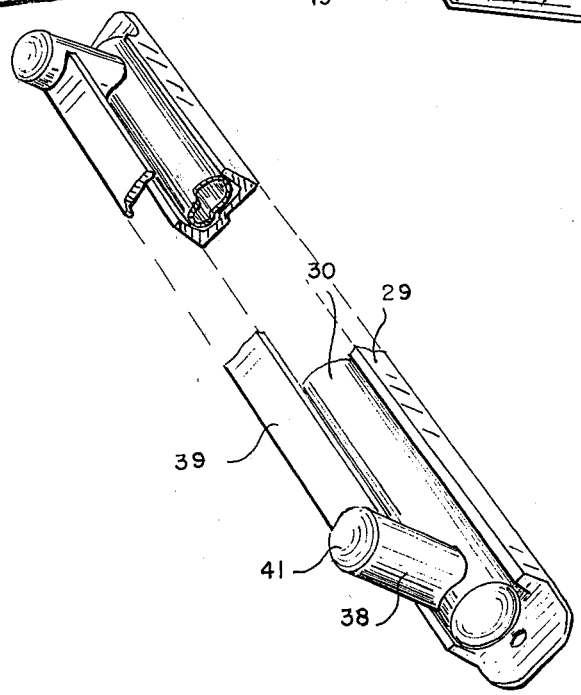
FIG. 2 is a fragmented perspective view of the paper strip retainer, drawn to substantially full scale.
Figure 3:
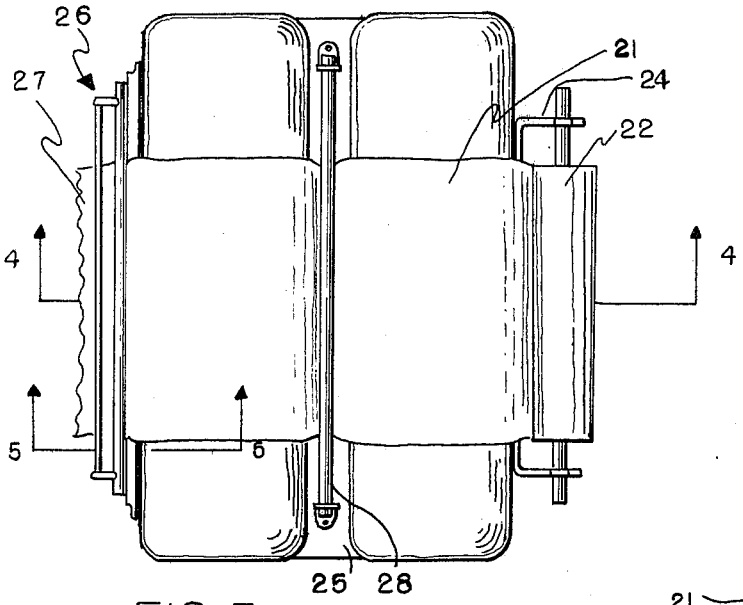
FIG. 3 is a plan view of the face supporting portion of the table of FIG. 1, drawn to a somewhat larger scale.
Figure 4:
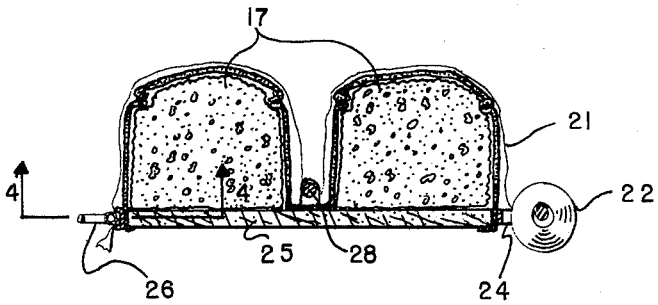
FIG. 4 is a fragmentary sectional view taken along line 4—4 of FIG. 3.

The patient normally rests in prone (face down) position upon said cushions, providing the physician ready access to the spinal regions, with face downwardly upon disposable sanitary paper strip 21 covering cushions 17. The paper 21 is stored in a supply roll 22 carried upon a rotatable spindle 23 held within a roller bracket 24 secured to cushion baseboard 25. (FIGS. 3 and 4) Secured to the opposite side of baseboard 25 is a paper retainer, generally 26, (FIG. 2) releasably clamping end 27 of paper strip 21. A paper guide rod 28 is secured to baseboard 25 between slightly spaced apart face cushions 17, assuring that paper strip 21 conforms generally to the upper contours of said cushions. The patient's face is thus comfortably supported by both cushions 17, with his nose and mouth free therebetween for unimpeded breathing above guide rod 28. (FIG. 4)

Figure 6:
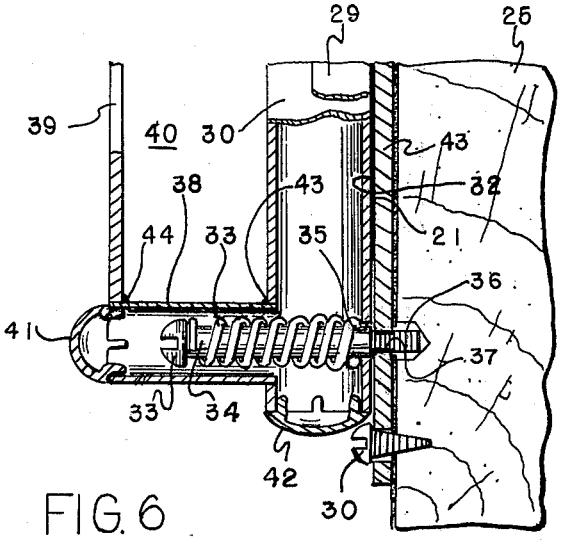
FIG. 6 is a fragmentary sectional view taken along line 6—6 of FIG. 5, drawn to substantially full scale.

Paper retainer 26 comprises an elongate channel shaped base member 29 secured to cushion baseboard 25 by screws 30, and an elongate tubular paper clamping member 30 urged toward contact with a flat surface 32 of base member 29 by each of a pair of compression coil springs 33. Springs 33 act between tube 30 and head 33 of each of a pair of shoulder bolts 34 serving as studs outstanding from base member 29. (FIG. 6) Bolts 34 each extend slideably through a bore 35 in tube 30 and shoulder against surface 32, threads 36 engaging threaded bore 37 in base member 29. A pair of outstanding tubular segments 38 secured to tube 30 partially house bolts 34 and springs 33. An elongate handle member 39 is secured to tube segments 38 distantly from tube 30 with a finger space 40 between. Tube segments 38 are each secured by welds or brazes 43 and 44 respectively. Domed snap-in covers 41 and 42 close the outermost ends of tube segments 38 and tube 30 respectively.

Figure 5:
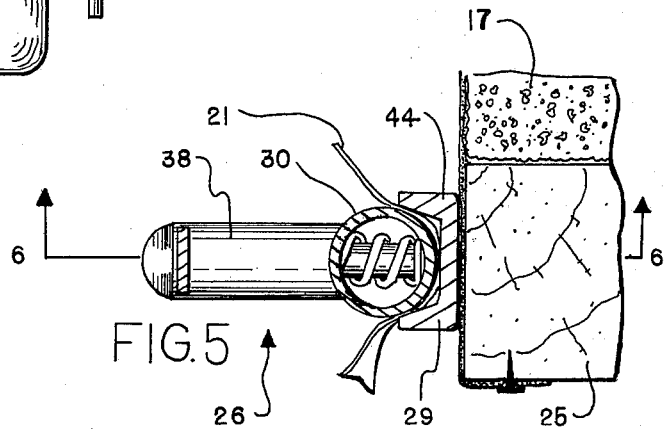
FIG. 5 is a fragmentary sectional view taken along line 5—5 of FIG. 3, drawn to substantially full scale.

The full width of paper strip 21 is gripped firmly between tube 30 and outer surface 32 of web 43 of channel base member 29, to prevent it from pulling out or excessively wrinkling when depressed into cushions 17 by the face of the patient. (FIG. 5) Tube 30 presses against flat surface 32 along a narrow line to grip paper strip 21 firmly even with easily compressed springs 33, allowing paper retainer 26 to be easily manipulated. Inwardly converging flanges 44 of channel 29 guide tube 30 toward surface 32. However, the designer may prefer to select tube 30 of a size to cause it to grip paper 21 generally against the insides of flanges 44, or even simultaneously against both of the flanges 44 and web 43.

Paper retainer 26 is preferably of metal, for strength, durability and dimensional stability. However, except for springs 33, plastic, wood or the like may be utilized without departing from the essential spirit of the invention. The designer may choose to score or otherwise roughen surface 32 of the surface of tube 30 for improved gripping of paper 21. However, this has not proven necessary, and could lead to difficulty in drawing paper 21 through retainer 26. The details of design may be altered in many respects without departing from the essential spirit of the invention. Base member 29 may be selected to be a flat plate, or a transversely arcuate strip. It may even be eliminated altogether (also it is preferred to provide the regular flat gripping surface 32), with bolts 34 in such event being extended to directly engage cushion baseboard 25, with paper 21 clamped between tube 30 and baseboard 25. Similarly, tube 30 may be replaced by any suitable elongate member, such as a plate or rod, so long as the replacing member carries a straight elongate line or surface properly disposed for matching contact with surface 32. Numerous acceptable spring means may be devised, to load whatever such member is selected, such as leaf springs or the like. The spring means could even be magnetic, with the retainer base 29 or the clamping member 30 being of permanently magnetized steel, and the stud bolts generally retaining and guiding clamping member 30. Medical tables other than the chiropractic table 10 may be utilized, with paper retainer 26 being appropriately sized and positioned on such tables. The embodiments illustrated and/or described herein are for illustrative purposes only, and are not intended to be restrictive. The boundaries of the present invention are those defined by the appended claims, and all embodiments therewithin, and all equivalents thereof, are intended to be embraced thereby.

I claim:

1. A chiropractic table assembly having a floor contacting base; a table member secured to the base, the upper surface thereof being adapted for a patient to pronely rest cushioned thereon; a rolled strip supply of disposable sanitary paper secured to the table member, a free end portion thereof changeably covering the face supporting portion of the upper surface; and a paper retainer comprising: an elongate retainer base secured to the table member and having an outwardly facing elongate surface extending at least the width of the paper strip transversely; an elongate paper clamping member with an inwardly disposed surface portion thereof in general matching relationship with the elongate surface of the retainer base; and spring means urging said member toward contact with said surface of the base, so that the free end of the paper strip is clamped therebetween; and wherein the paper clamping member has a pair of parallel bores, a one therethrough near each of its ends; and the spring means comprises: a pair of studs of generally smaller diameter than the bores, each having an enlarged end portion, and each being disposed in general axial alignment with a one of the bores and secured rigidly at its smaller end to and outstanding normally from the paper retainer base; and a compression coil spring disposed about each of the studs and acting between the enlarged end thereof and the clamping member urging it to clamp the paper against the paper retainer base.

2. The table of claim 1, wherein: the paper retainer base carries a pair of threaded bores; and each stud comprises a shoulder bolt, the threads thereof engaging a one of the threaded bores.

3. The table of claim 1, wherein: the clamping member is tubular and further comprises handle means secured thereto.

4. The table of claim 3, wherein: the outwardly facing elongate surface of the paper retainer base is transversely curved.

5. The table of claim 3, wherein: the paper retainer base comprises an outwardly opening channel.

6. The table of claim 1, wherein: the paper retainer base, the studs, and the paper clamping member are each of metal.

7. The table of claim 1, wherein: the paper retainer base, the studs, and the paper clamping member are each of substantially rigid plastic.

8. A paper retainer comprising: an elongate retainer base adapted to be secured to an examination table and having an outward facing elongate surface; an elongate paper clamping member with a surface portion thereof in general matching relationship with the elongate surface of the retainer base; and spring means urging said member toward contact with said surface of the base, so that a free end of a disposable paper strip for covering at least a portion of the table may be releasably gripped generally its full width between the retainer base and the clamping member, and wherein the paper clamping member has a pair of parallel bores, a one therethrough near each of its ends; and the spring means comprises: a pair of studs of generally smaller diameter than the bores, each having an enlarged end portion, and each being disposed in general axial alignment with a one of the bores and secured rigidly at its smaller end to and outstanding normally from the paper retainer base; and a compression coil spring disposed about each of the studs and acting between the enlarged end thereof and the clamping member urging it to clamp the paper against the paper retainer base.

9. A chiropractic table assembly having a floor contacting base; a table member secured to the base, the upper surface thereof being adapted for a patient to pronely rest cushioned thereon; a rolled strip supply of disposable sanitary paper secured to the table member, a free end portion thereof changeably covering the face supporting portion of the upper surface; and a paper retainer comprising: an elongate retainer base secured to the table member and having an outwardly facing elongate surface extending at least the width of the paper strip transversely; an elongate paper clamping member with an inwardly disposed surface portion thereof in general matching relationship with the elongate surface of the retainer base, and spring means urging said member toward contact with said surface of the base so that the free end of the paper strip is clamped therebetween; wherein the paper clamping member has a pair of unthreaded parallel bores, one therethrough near each of its ends; and the paper retainer base carries a pair of threaded bores; and a pair of studs are provided of generally smaller diameter than the unthreaded bores and disposed therethrough, each having an enlarged end portion and an opposite externally threaded end portion engaging one of the threaded bores so as to outstand normally from the paper retainer base; and a compression coil spring is provided disposed about each of the studs and acting between the enlarged end thereof and the clamping member urging it to clamp the paper against the paper retainer base.

10. A chiropractic table assembly having a floor contacting base; a table member secured to the base, the upper surface thereof being adapted for a patient to pronely rest cushioned thereon; a rolled strip supply of disposable sanitary paper secured to the table member, a free end portion thereof changeably covering the face supporting portion of the upper surface; and a paper retainer comprising: an elongate retainer base secured to the table member and having an outwardly facing elongate surface extending at least the width of the paper strip transversely; an elongate paper clamping member with an inwardly disposed surface portion thereof in general matching relationship with the elongate surface of the retainer base; and spring means urging said member toward contact with said surface of the base, so that the free end of the paper strip is clamped therebetween; the paper clamping member has a pair of parallel bores, one therethrough near each of its ends; and the spring means comprises: a pair of shoulder bolts of generally smaller diameter than the bores, and the paper retainer base carries a pair of threaded bores, the threads of the shoulder bolts each engaging one of the threaded bores and a compression coil spring disposed about each of the bolts and acting between the enlarged end thereof and the clamping member urging it to clamp the paper against the paper retainer base.

11. A chiropractic table assembly having a floor contacting base; a table member secured to the base, the upper surface thereof being adapted for a patient to pronely rest cushioned thereon; a rolled strip supply of disposable sanitary paper secured to the table member, a free end portion thereof changeably covering the face supporting portion of the upper surface; and a paper retainer comprising: an elongate retainer base secured to the table member and having an outwardly facing elongate surface extending at least the width of the paper strip transversely; an elongate paper clamping member with an inwardly disposed surface portion thereof in general matching relationship with the elongate surface of the retainer base; and spring means urging said member toward contact with said surface of the base, so that the free end of the paper strip is clamped therebetween; wherein: the clamping member is tubular and further comprises handle means secured thereto and has a pair of parallel unthreaded bores, one therethrough near each of its ends; and the spring means comprises: a pair of studs of generally smaller diameter than the bores, each having an enlarged end portion, and each being disposed in general axial alignment with a one of the bores and secured rigidly at its smaller end to and outstanding normally from the paper retainer base; and a compression coil spring disposed about each of the studs and acting between the enlarged end thereof and the clamping member urging it to clamp the paper against the paper retainer base.

12. The table of claim 11, wherein: the outwardly facing elongate surface of the paper retainer base is transversely curved.

13. The table of claim 10, wherein: the paper retainer base comprises an outwardly opening channel.

14. The table of claim 10, wherein: the paper retainer base, the studs, and the paper clamping member are each of metal.

15. The table of claim 11, wherein: the paper retainer base, the studs, and the paper clamping member are each of substantially rigid plastic.

* * * * *